US008608631B2

(12) United States Patent
Mitchell

(10) Patent No.: US 8,608,631 B2
(45) Date of Patent: Dec. 17, 2013

(54) FULL BODY EXERCISE MACHINE

(76) Inventor: Dean MacCauther Mitchell, Panama City, FL (US)

( * ) Notice: Subject to any disclaimer, the term of this patent is extended or adjusted under 35 U.S.C. 154(b) by 279 days.

(21) Appl. No.: 13/079,080

(22) Filed: Apr. 4, 2011

(65) Prior Publication Data

US 2011/0245043 A1 Oct. 6, 2011

Related U.S. Application Data

(60) Provisional application No. 61/341,606, filed on Apr. 2, 2010.

(51) Int. Cl.
*A63B 21/00* (2006.01)

(52) U.S. Cl.
USPC ..... 482/130; 482/72; 482/142

(58) Field of Classification Search
USPC ..... 482/142, 130, 212, 121, 72, 57, 62
See application file for complete search history.

(56) References Cited

U.S. PATENT DOCUMENTS 6,461,284 B1 * 10/2002 Francavilla ..... 482/142
6,634,998 B2 * 10/2003 Siaperas ..... 482/142
7,611,450 B2 * 11/2009 Mancini ..... 482/130
8,056,976 B1 * 11/2011 Polk ..... 297/271.5
2010/0210425 A1 * 8/2010 Bowser ..... 482/62

* cited by examiner

*Primary Examiner* — Jerome W Donnelly

(74) *Attorney, Agent, or Firm* — Maxey Law Offices, PLLC; Stephen Lewellyn

(57) ABSTRACT

The present device discloses a complete full body exercise machine. The recumbent exercise apparatus comprises three upper body assemblies and a lower body assembly. This exercise machine provides the user the capability to effectively work the entire upper body with a wide variety of exercises and multiple resistance levels while simultaneously being able to exercise the lower body. Each upper body assembly comprises a plurality of elastic bands connected between the frame and handle members. The handle support locations and connecting elastic bands are adapted to permit a full range of motion for a variety of upper body exercises without having to pause to switch upper body exercises or change resistant levels while exercising with the lower body assembly. The handles are movably supported on the frame to allow the connecting elastic bands to be in a pretension state for full range of resistance throughout each movement of each upper body exercise.

11 Claims, 2 Drawing Sheets

FULL BODY EXERCISE MACHINE

This application emanates from a previous application filing which is related to, and claims priority through earlier filed U.S. Provisional Application No. 61/341,606, filed Apr. 2, 2010, all the subject matter of which are herein incorporated by this reference thereto in their entirety for all purposes.

FIELD OF THE INVENTION

The present invention relates to equipment for physical exercise, in particular to a multi-function exercise machine for training the abdominals, chest, shoulders, back, arms, legs and related cardiovascular system.

BACKGROUND OF THE INVENTION

Generally, various types of exercise equipment has been proposed for different exercise motions, for instance of the treadmill machine, the stationary bike, the elliptical or other gym apparatuses for fitness and muscle exercises. Most of those devices on the market usually concentrate on aerobic training via working the legs in some form. Some of those machines permit a user to exercise a given muscle group of the upper body via some sort of resistance mechanism such as elastic bands attached to a pair of handles.

These devises, however, fail to achieve a design wherein the primary exercise components such as the handles are strategically located and positioned in such a way that the user can efficiently grasp the handles and effectively exercise all muscle groups of the entire upper body while remaining seated and maintaining an uninterrupted exercise routine of the lower body. A full body exercise machine that permits the user to remain in a seated position working the lower body, and being able to work a large variety of upper body exercises with multiple resistant levels without having to stop the lower body workout. The exercise machine as described herein is well adapted to provide an exercise machine for a complete cardio and resistant training workout for the user.

Dual action machines of aerobic and anaerobic capabilities have many benefits, including a more complete full body exercise that includes both the capability of working upper body while simultaneously working the lower body. The increased work raises the user's metabolism and heart rates more quickly than single action machines, and maintains the higher metabolism and heart rate throughout the workout. Such machines are therefore more efficient, providing more exercise in less time.

SUMMARY OF THE INVENTION

The present invention provides a recumbent exercise apparatus that allows a person to work the lower body and simultaneously work the upper body with variety of upper body exercises and with variable resistant levels. Unlike many other devices within existing art, the current invention allows a person avoid a pause in training to be able to switch from one upper body exercise to the other and with variable resistance levels while remaining seated and working the lower body.

The recumbent exercise apparatus with a pedaling mechanism for the lower body and a plurality of resistant bands connected between the frame and handle members. A first, second and third upper body assemblies are attached to the frame assembly. The first exercise assembly comprises of elastic bands connected between an adjustable rear boom and a plurality of handle members supported near the seat assembly. The second upper body exercise assembly is comprised of elastic bands connected between the lower portion of the frame assembly and the handle members supported near the seat assembly. The third upper body assembly is comprised of elastic bands connected between an adjustable front boom and a plurality of handle members supported at the forward portion of the frame assembly.

In the exercise assemblies, the elastic bands are configured with strategic angles to provide resistance in front, behind and below the user. The plurality of handle members attached to the resistant bands allows the user to engage in variable resistance training for each upper body exercise.

Generally on conventional machines where resistance is provided behind the user for seated chest exercises, the handle members would be supported to the side at approximately the chest level and slightly behind the user while not in use. This configuration does not provide the capability for user engagement of other exercises such as the seat shoulder press and shoulder laterals without having to pause to change exercise devices or make adjustments. To overcome this obstacle what is needed is a machine that, while the lower body is being trained, the entire upper body can be trained with a variety of different exercises, multiple resistant levels, all while remaining seated and without having to pause to change resistance levels or upper body exercise. With the present invention, the first upper body assembly is comprised of a rear boom that supports the connection of elastic bands which provides resistance behind the user. The handle members of the first upper body assembly are supported beside the user adjacent to the seat pad. The handle members of the second upper body assembly are supported forward of the first upper body assembly and beside the user near the seat assembly. The connection angle of the bands of the first and second upper body assemblies and the handle support locations permit the freedom of space and movement for the hands in multi-planar directions. This freedom of space allows the user to perform such exercises as seated shoulder presses and side laterals while having the capability to work the chest with seat presses, laterals or pullovers while never having to adjust frame members or change devices.

The plurality of handle members of the third upper body assembly are mounted forward of the user and above the lower body exercise assembly for user engagement while the user is working the lower body in a seated position.

The elastic bands are connected to handle members that are supported by handle support pins. The handle support pins also allow the bands to remain at a pretension level, if desired by the user, to allow an adequate level of resistance through a full range of motion. For example, if you are performing seated chest laterals or bicep curls, the user would feel resistance at the beginning and end of the full movement.

The lower body exercise assembly of the present invention comprises a pedaling mechanism, which has a difficulty control mechanism known to the art such as a flywheel with magnetic resistance, tension band, or the like. This circular pedaling motion of the pedals via a variable resistance mechanism provides the user an effective lower body workout and cardiovascular training. The lower body workout could be provided by non-circular or eccentric pedal movements to include elliptical, linear or any other movements of the like.

The exercise options for the upper body include presses, pullovers and laterals for the chest; presses, upright rows, and laterals (front, side and back) for the shoulders; seated rows and pullovers for the back; extensions and kickbacks for the triceps; curls for the biceps; and crunches and side bends for the abdominals. This exercise machine is a fully versatile and an efficient machine for achieving outstanding full body workouts via simultaneously working the upper body and the lower body with pedaling movement.

DETAILED DESCRIPTION OF THE DRAWINGS

Figure 1:
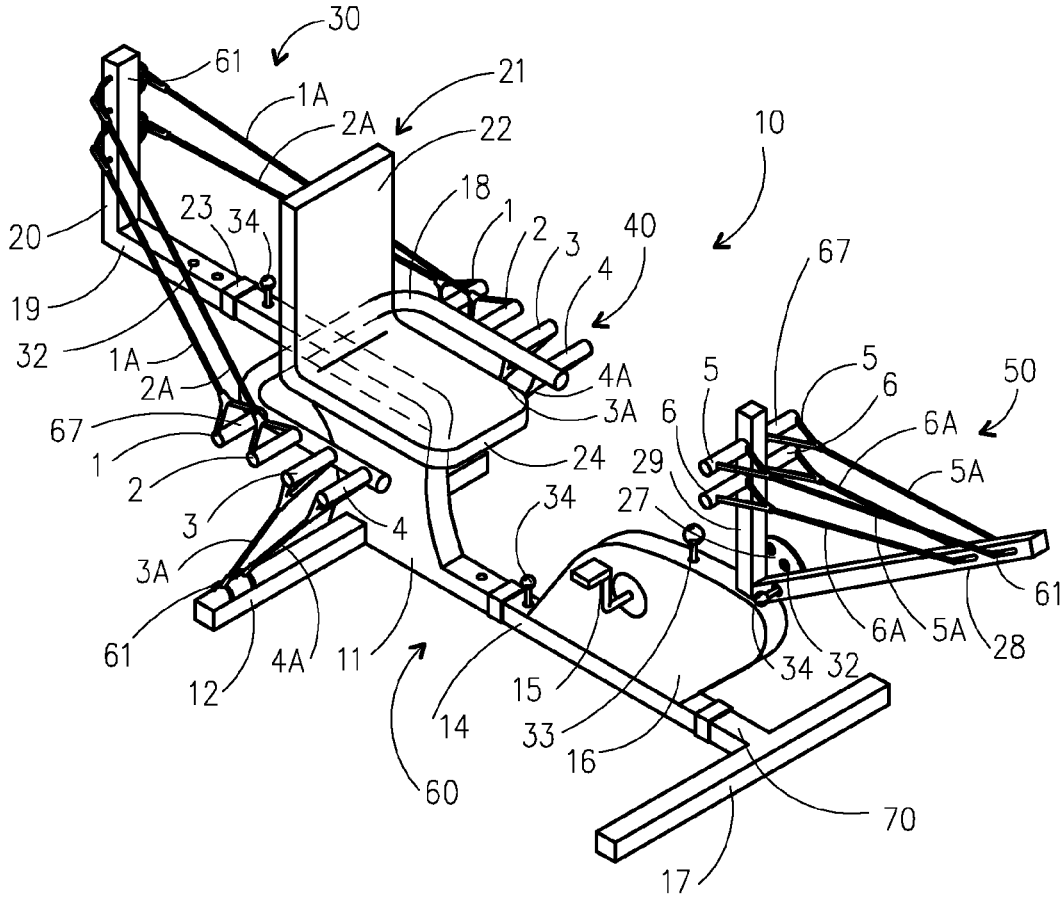
FIG. 1 is a perspective view of the preferred exercise apparatus according to present invention.

With reference to FIG. 1 exercise apparatus is shown therein. The full body exercise machine 10 comprises a seat assembly 21 with an integrally mounted seat pad 24 and a back rest 22 supported by a simplified frame assembly 60. The frame assembly further comprises a lower leg assembly 16 and a first, second, and third upper body assemblies 30, 40, 50. The illustrated frame assembly 60 comprises a longitudinal support member 70 with a connecting front transverse member 17 and a back transverse member 12. In the illustrated arrangement of FIG. 1, the longitudinal support member 70 and the front and rear transverse members 17,12 are separately formed and secured together in a suitable manner, including but not limited to welding, physical interlocking connection, mechanical fasteners and the like. In some embodiments the longitudinal support member 70 and the front and rear transverse members 17,12 are integrally formed.

A rear vertical support member 11 is rigidly connected to the longitudinal support member 70 and extends vertically to connect to a rigid boom member 23. In the illustrated arrangement of FIG. 1, the seat assembly 21 is rigidly mounted to the rigid boom member 23 to support the user in a recumbent position while using the full body exercise machine 10. The first upper body assembly 30 comprises a rigid boom member 23 with an inner rear boom member 19 that can adjusted to the user by sliding in a telescopic fashion. The inner rear boom member 19 can be securely locked in position using a plunger pin 34. Mounting holes 32 consecutively aligned along the inner rear boom member 19 are used for receiving the plunger pin at the desired location of the user. The rear boom arm 20 mounted to the distal end of the inner rear boom member 19 has rings 61 mounted to the distal end for fastening the second end of each first elongated member 1A, 2A as shown in illustrated arrangement of FIG. 1. As illustrated in FIG. 1 arrangement, a plurality of first handle members 1,2 are detachably connected to a first end of each first elongated member 1A,2A. Each first handle member is moveably supported by handle support pins 67. The handle support pins 67 are rigidly connected in a cantilever fashion to a handle support bracket 18. The handle support bracket 18 is rigidly mounted to the rigid boom member 23 adjacent to the seat pad 24. Each handle support pin 67 receives each handle member in a telescopic fashion for supporting the handle members while not engaged by the user. Each handle support pin 67 is strategically located adjacent to the seat pad 24 for easy access to the first and second hand members 1,2 by the user.

Although reference is made in describing the user ability to work the upper body assemblies one, two, or three 30,40,50 simultaneously with the lower body assembly 16, the user does have the option to work each upper body assembly 30,40,50 independently and separately of the lower body assembly.

Each first, second and third elongated member 1A, 2A, 3A, 4A, 5A, 6A of the illustrated example in FIG. 1 are resistance devises comprising of elastic bands that are generally inexpensive and effective for resistant training. The term elastic bands is used herein to refer to any type of material that has elasticity. The resistance for the elastic bands can be varied by changing the length of the band, change the strength of the band or change the number of bands. Although in the preferred embodiment the full length of each first, second and third elongated member 1A, 2A, 3A, 4A, 5A, 6A is comprised of an elastic material, a portion of the each elongated member could be comprised of a non-elastic material such as a steel cord, rod member or the like. The elastic bands may also be supported by user preference a level of pretension via support the handle support pins 67 to achieve a full range of resistance throughout the beginning and end of each upper body exercise.

In the first upper body assembly 30, the various upper body exercises that can be performed by the user in a seated position while simultaneously working the lower body are seat presses, laterals and pullovers for the chest, pullovers for the back and chest; extensions and presses for the triceps; and crunches, side bends or twist for the abdominals. The neck could also be trained if the user desired. It must be noted that all of the aforementioned exercises can be performed with variable resistance levels by having access to a plurality of first handle members 1,2 strategically supported for user engagement.

Figure 2:
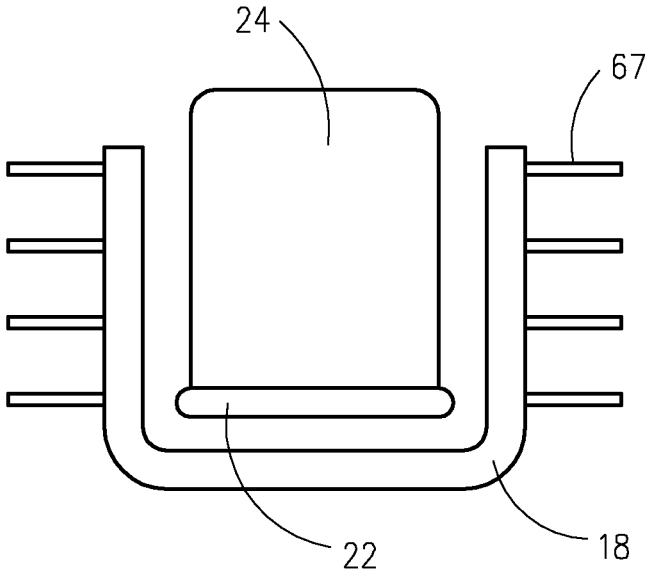
FIG. 2 is a top plan view of the seat assembly, handle support bracket and handle support pins.

The second upper body assembly 40 as shown in FIG. 1 illustration, comprises a plurality of second handle members 3,4 movably supported by handle support pins 67 located adjacent to the seat pad 24. Each second handle member 3,4 is detachably connected to a first end of each second elongated member 3A,4A. FIG. 2 illustration shows a plan view of the handle support pins 67 with the first and second handle members 1,2,3,4 being removed. The second end attachment of each second elongated member 3A,4A is detachably connected to a pair of rings 61 rigidly mounted and separated by a determined distance on each side of the rear transverse member 12. In the second upper body assembly 40, the various upper body exercises that can be performed by the user in a seated position while simultaneously working the lower body assembly are seat presses, side laterals, and shrugs for the shoulders; curls for the biceps; extensions and kickbacks for the triceps; wrist curls for the forearms; and side bends and twists for the abdominals.

Figure 3:
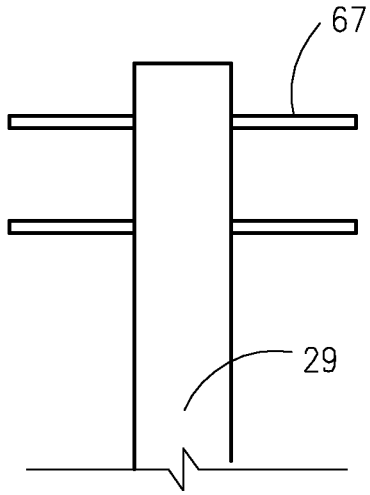
FIG. 3 is a partial selective view of the front vertical member and handle support pins.

The third upper body assembly 50 as shown in FIG. 1 illustration, is mounted at the forward portion of the frame assembly 60 and comprises a plurality of third handle members 5,6 movably supported by handle support pins 61 connected in a cantilever fashion to the front vertical member 29 as further illustrated in FIG. 3. The front vertical member 29 is mounted at the forward portion of the frame assembly 60 and extends at a determined distance above and forward of the seat pad 24. Each third handle member 5,6 is detachably connected to each a first end of each third elongated member 5A, 6A. The second end attachment of each third elongated member 5A,6A is detachably connected to a pair of rings 61 rigidly mounted and separated by a determined distance on each side of the front boom member 28. The front boom member 28 is pivotally mounted to the front vertical member 29. The front boom member can be adjusted to a user preference via a plunger pin 34 that can aligned with mounting holes 32 consecutively aligned along a hinge 27 mounted between the front vertical member 29 and the front boom member 28. The various upper body exercises that can be performed by the user while in a seated position while simultaneously working the lower body assembly are rows for the back; front raises and laterals for the shoulders; curls for the biceps; kickbacks for the triceps.

The aforementioned exercises as described in the upper body assemblies one, two and three are included, but limited to, in identifying what is available to the user while the user is working the lower body in a seated position. It must also be emphasized that the user can switch from one upper body exercise to the other and with variable resistant levels without pause while working the lower body assembly 16.

The lower body assembly 16 as illustrated in FIG. 1 is comprised of a pedaling mechanism 15 of the known design. A pedaling mechanism 33 has a difficulty control mechanism that can be adjusted by the user using the difficulty control knob 33. The pedaling mechanism 15 mounted on an outer telescoping member 14 that slides forward and backward to adjust to arm and leg lengths of the individual user. The outer telescoping member comprises a plunger pin 34. The longitudinal support member 70 is comprised of mounting holes that are consecutively placed to align and lock in place the assemblies as an integral unit using the plunger pin 34. The user can adjust both the upper body assembly 50 and the lower leg assembly 16 to his or her individual body size.

What is claimed is:

1. An exercise apparatus that allows for simultaneous exercise of both the upper and lower portions of the body comprising:

a frame, said frame comprising a rearward portion and a forward portion along a longitudinal axis;

a seat assembly mounted on said rearward portion of said frame, said seat assembly comprising a seat pad and a back rest;

a lower body exercise assembly mounted to said forward portion of said frame;

a first upper body exercise assembly mounted to said rearward portion of said frame, said first upper body exercise assembly comprising:

a plurality of first left side handle members movably supported along a left side of said longitudinal axis of said frame adjacent to said seat pad that can be engaged by a user while in a seated position; a plurality of first left side elongated members each attached at a first end to a rearward portion of said frame above said seat pad, each left side handle member a respective second end of one of said first left side elongated members; a plurality of first right side handle members movably supported along a right side of said longitudinal axis of said frame adjacent to said seat pad that can be engaged by a user while in a seated position; and a plurality of first right side elongated members each attached at a first end to a rearward portion of said frame above said seat pad and each first right side handle member connected to a respective second end of one of said first right side elongated members;

a second upper body exercise assembly mounted to said rearward portion of said frame, said second upper body exercise assembly being formed separate of said first upper body exercise assembly, said second upper body exercise assembly comprising:

a plurality of second left side handle members movably supported along a left side of a longitudinal axis of said frame adjacent to said seat pad that can be engaged by a user while in a seated position; a plurality of second left side elongated members each attached at a first end to said rearward portion of said frame below said seat pad, and each second left side handle member being connected to a respective second end of one of said second left side elongated members; a plurality of second right side handle members movably supported along a right side of said longitudinal axis of said frame adjacent to said seat pad that can be engaged by a user while in a seated position; and a plurality of second right side elongated members each attached at a first end to a rearward portion of said frame below said seat pad, and each second right side handle member connected to a respective second end of one of said second right side elongated members;

a third upper body exercise assembly mounted to said forward portion of said frame, said third upper body exercise assembly being formed separate of said first upper body exercise assembly and said second upper body exercise assembly, said third upper body exercise assembly comprising:

a plurality of third handle members movably supported at a forward portion of said frame and adjacent to a lower body exercise assembly, wherein each can be engaged by a user while in a seated position; and a plurality of third elongated members each attached at a first end to said forward portion of said frame, and each third handle member connected to a respective second end of one of said third elongated members;

a handle support bracket having a left side member disposed on a left side of said seat and a right side member disposed on a right side of said seat;

a plurality of handle supporting pins attached to and spaced along said left side member and said right side member of said handle support bracket, each of said first left side handle members and each of said second left side handle members removably supported by a respective one pin on said left side member, and each of said first right side handle members and each of said second right side handle members removably supported by a respective one pin on said right side member; and wherein one or more of said first left side handle members, said first right side handle members, said second left side handle members, said second right side handle members, or said third handle members must be released from its respective handle supporting pin to allow a user to operate said first upper body exercise assembly, said second upper body exercise assembly, or said third upper body exercise assembly, respectively.

2. The exercise apparatus of claim 1, wherein said lower body exercise assembly comprises a pedaling mechanism.

3. The exercise apparatus of claim 2, wherein said pedaling mechanism comprises a difficulty control mechanism to control a difficulty of pedaling.

4. The exercise apparatus of claim 1, wherein a rear portion of said frame comprises an adjustable telescoping boom for a second end attachment of said first elongated member.

5. The exercise apparatus of claim 1, wherein said first left side elongated members and said first right side elongated members are one or more elastic bands or portion thereof to provide a desired resistance to a user.

6. The exercise apparatus of claim 1, wherein said second left side elongated members and said second right side elongated members are one or more elastic bands to provide a desired resistance to a user.

7. The exercise apparatus of claim 1, wherein said third elongated member are one or more elastic bands to provide a desired resistance to a user.

8. The exercise apparatus of claim 1, further comprising:

a vertical member mounted to said forward portion of said frame; and a plurality of handle supporting pins attached to and spaced along said vertical member, each of said third handle members removably supported by a respective one pin of said vertical member.

9. The exercise apparatus of claim 1, wherein said handle support bracket is rigidly mounted to said frame, and said left side member and said right side member each extend forwardly along the left and right sides, respectively, of said seat pad and in a direction from said rearward portion to said forward portion of said frame.

10. The exercise apparatus of claim 9, wherein said handle support bracket is U-shaped.

11. The exercise apparatus of claim 9, wherein each of said handle support pins are rigidly connected in a cantilever fashion to said handle support bracket.

* * * * *